United States Patent [19]

Hatem

[11] 4,310,739

[45] Jan. 12, 1982

[54] FLUID HEATER POWERED BY MICROWAVE ENERGY

[76] Inventor: John P. Hatem, 2813 Pheasant Hollow Dr., Plainsboro, N.J. 08536

[21] Appl. No.: 151,089

[22] Filed: May 19, 1980

[51] Int. Cl.[3] ..... H05B 6/80

[52] U.S. Cl. ..... 219/10.55 A; 219/10.55 R; 219/10.55 M; 219/365

[58] Field of Search ..... 219/10.55 A, 10.55 R, 219/10.55 F, 10.55 M, 365, 298, 297

[56] References Cited

U.S. PATENT DOCUMENTS

| | | | |
|---|---|---|---|
| 2,978,562 | 4/1961 | Fox | 219/10.55 R |
| 3,778,578 | 12/1973 | Long et al. | 219/10.55 R |
| 3,891,817 | 6/1975 | Brown | 219/10.55 R |
| 3,920,945 | 11/1975 | Smith et al. | 219/10.55 R |
| 4,029,927 | 6/1977 | McMillan | 219/10.55 R |
| 4,178,494 | 12/1979 | Bottalico et al. | 219/10.55 R |

*Primary Examiner*—Arthur T. Grimley

[57] ABSTRACT

The fluid heater of this invention employs electromagnetic energy (microwaves) to heat the fluid. The magnetron supplies this energy into a base structure which is juxtaposed but separate from the fluid bearing container. The energy is directed towards the fluid container by a stirrer mounted in the base structure, which rotates at a relatively slow rate. The design of the container is such that the fluid flows in a serpentine fashion. Baffles are arranged and positioned to provide this serpentine path. A fan is provided to cool the magnetron. Standard plumbing means and a circulator pump are provided for entry and exit of fluid as well as an aquastat for critical temperature sensing. Drain and pressure controls are also provided.

9 Claims, 6 Drawing Figures

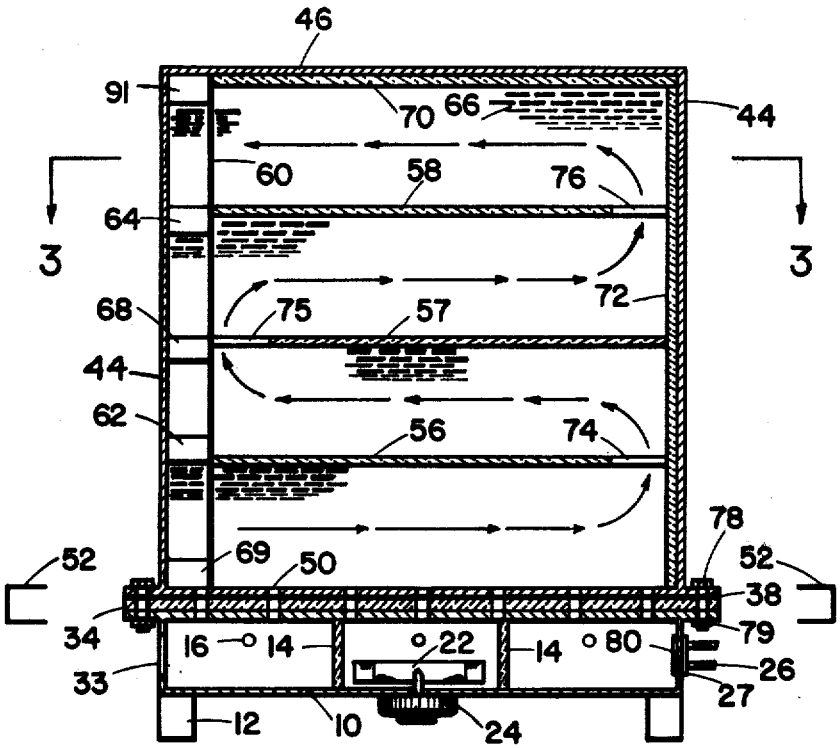
FIG. 2
FIG. 3
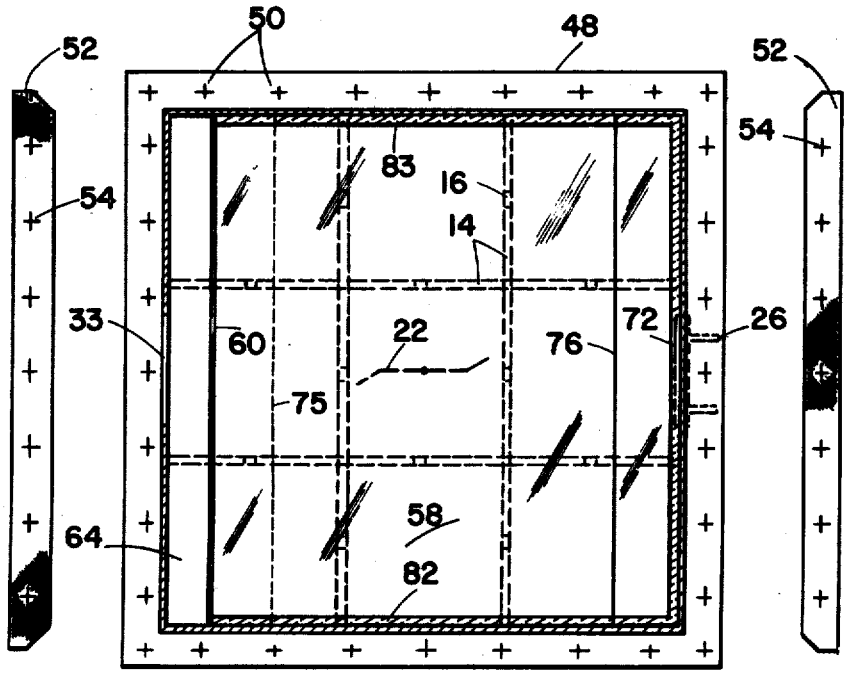

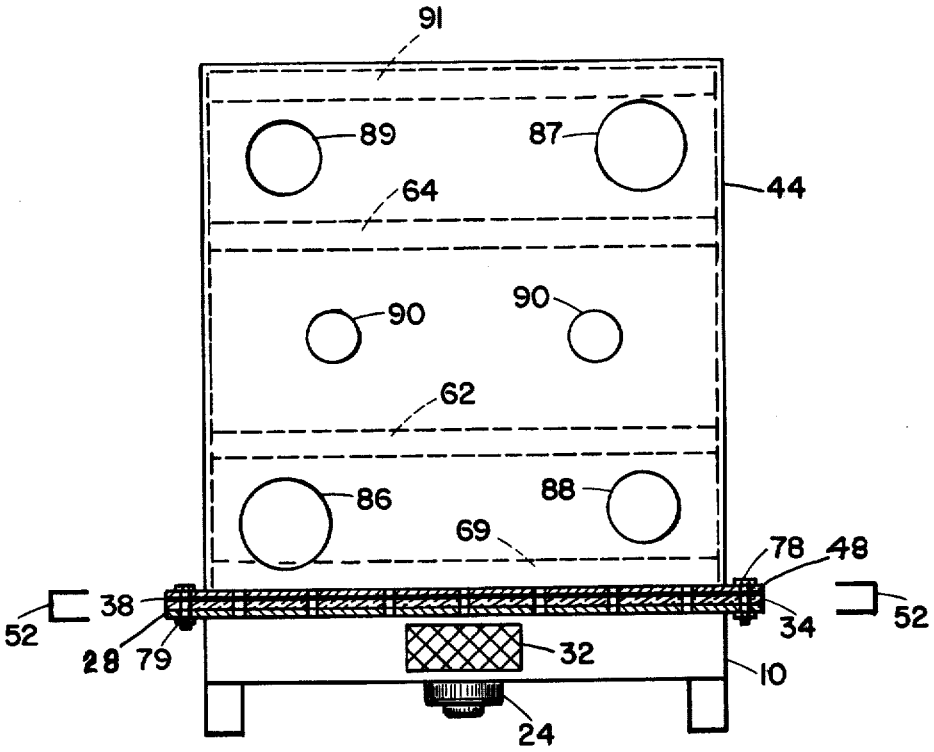
FIG. 4
FIG. 5
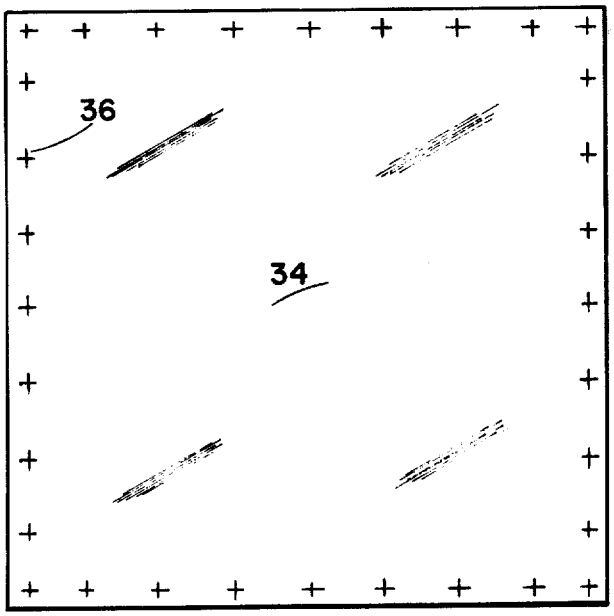

FLUID HEATER POWERED BY MICROWAVE ENERGY

BACKGROUND OF THE INVENTION

1. Field of the Invention

With reference to the field of art as established by and in the United States Patent Office the present invention is believed to be found in the general class entitled, "Electric Heating" (Class 219) and in the subclass therein entitled, "Electromagnetic Wave Irradiation" (subclass 10. 55R).

2. Description of the Prior Art

Microwave energy has been known for many years and in particular has become very popular in the field of cooking. This efficient use of energy has also been shown as a heating source or method for fluid, particularly water. Among the prior art patents for such heating devices are U.S. Pat. No. 3,920,945 to SMITH et al as issued on Nov. 18, 1975 and U.S. Pat. No. 4,165,455 to MAYFIELD on Aug. 21, 1979. In these and other prior art devices for fluid heating the use of microwave energy is directed upon the fluid within the boiler or chamber. This often presents a screening problem and does not provide an indirect and efficient use of the electromagnetic source. The magnetron is usually arranged to contact the fluid flow.

SUMMARY OF THE INVENTION

This invention may be summarized, at least in part, with reference to its objects. It is an object of this invention to provide a fluid heater which uses electromagnetic energy to heat the fluid in a container.

It is a further object of this invention to provide a fluid heater in which the fluid is heated by an electromagnetic energy source but the heat is indirectly applied to the fluid.

In brief, this heater includes a water or fluid receiver with an inlet and an outlet. The container has welded in place baffles at the inlet and outlet. These baffles are to the outside of a stainless steel wire mesh screen which is arranged along one side of the receiver. The tank itself has baffles arranged to cause a serpentine flow of fluid. The base is made with compartments and a microwave energy stirrer that is centrally located. The fluid is heated by energy reflected by the stirrer. The electromagnetic energy producer (magnetron) is disposed to the outside of the base. There is no water in the base and the fluid in the cover is separated from the base by a sheet of plexiglass. A gasket seal and U-shaped clips of wire mesh, together with the above wire mesh screen, prevent the escape of microwave energy from the heater apparatus. Insulation to prevent a loss of heat energy is also contemplated.

In addition to the above summary the following disclosure is detailed to insure adequacy and aid in understanding of the invention. This disclosure, however, is not intended to cover each new inventive concept no matter how it may later be disguised by variations in form or additions of further improvements. For this reason there has been chosen a specific embodiment of a fluid heater as adopted for use with electromagnetic energy heating and showing a preferred means for constructing the heater. This specific embodiment has been chosen for the purposes of illustration and description as shown in the accompanying drawings wherein.

BRIEF DESCRIPTION OF THE DRAWINGS

FIG. 2 represents a diagrammatic side view, partly in section, of the fluid heater of FIG. 1;

FIG. 3 represents a plan view, partly diagrammatic, and showing the fluid heater of FIG. 2, this view taken on the line 3—3 and looking in the direction of the arrows;

FIG. 4 represents an exterior side view and partly diagrammatic in that the joint in which the cover is bolted to the base is shown in section;

FIG. 5 represents a plan view of the plexiglass separator sheet between the cover and heat chamber labrinth.

In the following description and in the claims various details are identified by specific names for convenience. These names are intended to be generic in their application. Corresponding reference characters refer to like members throughout the several figures of the drawings.

The drawings accompanying, and forming part of, this specification disclose details of construction for the purpose of explanation but structural details may be modified without departure from the concept and principles of the invention and the invention may be incorporated in other structural forms than shown.

DESCRIPTION OF THE PREFERRED EMBODIMENT

Figure 1:
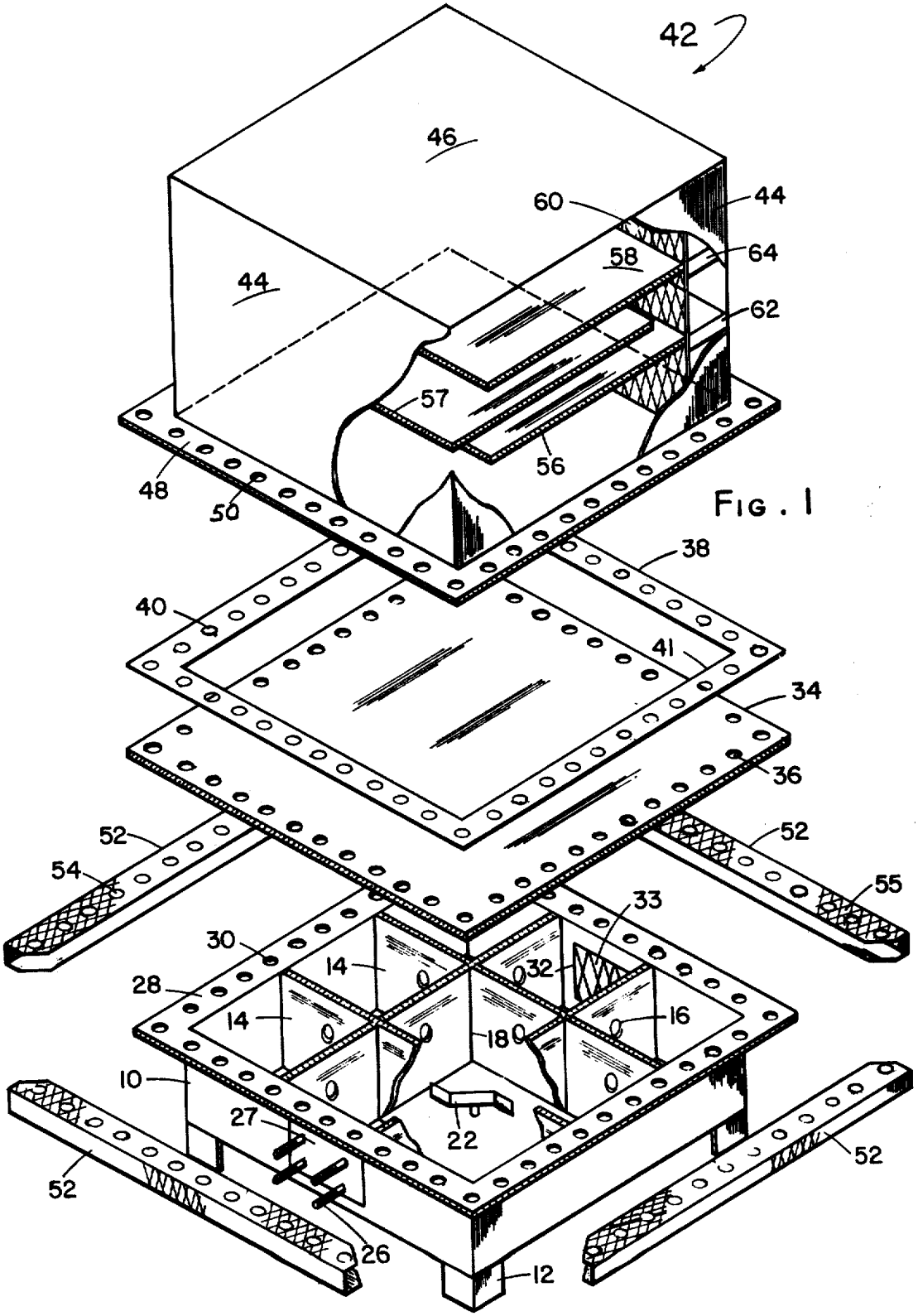
FIG. 1 represents an exploded isometric view of the fluid heater apparatus, this view partly in section and with portions of the cover and base broken away to show the arrangement and operation of the several interacting components.

The apparatus for heating fluid, such as water, by electromagnetic energy is depicted in the exploded isometric view of FIG. 1 in which a base 10 is conventionally formed on its outside with legs 12 extending downwardly to provide an air passageway and space. The inner portion of this base, as shown, has intermediate walls 14 to provide nine substantially equal areas. These intermediate walls are of plexiglass with holes 16 formed in each intermediate wall. These walls are joined at intersections or right angles 18. In the central or middle area there is provided a stirrer blade 22 which is rotated by a motor 24 as seen in FIGS. 2 and 4.

In the near wall there is secured a stud mounting means 26 which is adapted to retain the magnetron apparatus. These studs are secured to or are next to an exterior plate 27 through which the electromagnetic (microwaves) energy is passed. An outwardly directed flange 28 has regularly spaced and sized holes 30 arranged for the securing of a cover and gasket to later be described. A wire mesh screen 32 (stainless steel) is secured to opening 33 and provides an air vent of the interior of the base. This mesh also provides a trap to prevent unwanted escape of the microwave energy from the base 10.

As depicted, a Plexiglass (T. M. Rohm & Haas Co.), methylmethacrylate sheet 34 is substantially flat and square. A series of holes 36 in said sheet are of a size and spacing that is compatible with holes 30 in flange 28. A gasket 38 is sized to mate with the outer extent of the plexiglass sheet 34. Holes 40 are sized and spaced to be compatible with the holes 30 and 36, above identified.

This gasket has an outer periphery with a central through aperture 41.

A cover member, generally identified as 42, has sidewalls 44 and a top 46 which are constructed so as to be fluid tight. A flange 48 is of a size to be compatible with the plexiglass sheet 34 and the flange 28 on the base 10. This flange has a series of holes 50 which are sized and spaced to mate with the holes in lower member portions. Outer U-clips or channels 52, as shown, are of like size and have holes 54 formed therein. These holes are sized and spaced so as to mate with the flanges 28 and 48 and with the gasket 38 and the plexiglass sheet 34. These U-clips contain a metal mesh screen 55 which provides an inhibiting means against escape of microwave energy.

In the construction of the interior of the cover member 42 there are three baffles 56, 57 and 58. These baffles, as seen in FIG. 2, are arranged to provide a serpentine path of the fluid. There is a screen 60 arranged at one end of the chamber. At the right end or side of said chamber, as seen in FIG. 1, there are upper and lower baffle members 62 and 64. The assembly and use are shown in greater detail in the later discussed FIGS.

ASSEMBLY OF FLUID HEATER AS IN FIG. 2.

The fluid heating apparatus is shown in FIG. 2 and, as arranged, the base 10 is of metal and has legs 12 which support the apparatus. Motor 24, which rotates the stirrer 22, extends less downwardly than the extended length of the legs. The intermediate walls 14 of plexiglass extend to the intermediate plexiglass sheet 34. Above this sheet is a chamber in which water or fluid is contained and identified as 66. Baffles 56, 57 and 58 are arranged to provide a serpentine path for the fluid as it is brought in and out of the chamber. Baffles 62 and 64 are secured to the left sidewall 44 and with spacers 68 and 69 serve to retain and maintain the screen 60 in position.

The upper end or top of the water or fluid chamber has a plexiglass liner 70. A plexiglass wall member 72 is disposed at the right wall and like inner walls, later identified, are at the near and far walls interior of the sidewall 44. Cutouts 74, 75 and 76 provide for fluid flow as indicated by the arrows. Bolts 78 pass through the holes in the flanges 28 and 48 and through like holes 36 and 40 in the plexiglass sheet 34 and gasket 38 and with nuts 79 secure the flanges. Also to be seen in this view is a plexiglass member 80 which, with the exterior plate 27, is arranged at the output of a magnetron.

APPARATUS AS IN FIG. 3

Referring next to FIG. 3 there is depicted the fluid heating apparatus as seen in a plan view at line 3—3. The visible flange 48, for purposes of simplicity, is shown with centerlines indicating the bolt hole spacing. These centerlines correspond to the spacing and size of holes 50 and like holes in lower member. The U-clips 52 are likewise shown with center line designations representing a desired spacing and size of holes 54. An opening 33 is shown in the left wall. The metal mesh screen 60 is also identified. Cutout opening 76 is shown in solid outline and cutout opening 74 is below. Cutout opening 75 is shown in dotted outline as it lays below baffle plate 58. Wall member 72 is also shown as near wall 82 and far wall 83, also of plexiglass, both of which terminate at the metal mesh screen 60. The intermediate walls 14 and the holes 16 are also shown. The stirrer blade 22 is depicted as in the center of the apparatus. The mounting stud means 26 are also shown.

SIDE VIEW OF APPARATUS AS IN FIG. 4

Referring next to FIG. 4 there is depicted the fluid heating apparatus generally seen from the plumbing connecting side of the assembly. The flanges 28 and 48, the gasket 38 and the plexiglass member 34 are shown diagrammatically in section. As shown, the housing or sidewalls 44 are formed with pipe fittings which are represented diagrammatically with selectively sized circles. The side wall 44 has at its lower left a one and one-half inch threaded inlet 86 through which the fluid or water is fed into the chamber. A like sized hot water outlet 87 is shown at the upper right. A drain outlet 88 is at the lower right and, as reduced to practice, is a one inch threaded pipe connector. A like sized connector 89 is shown at the upper left and is adapted for a pressure relief connection.

Aquastats are mounted in connectors 90 which, as reduced to practice, are three-quarters of an inch pipe connectors and are threaded accordingly. A typical aquastat unit would be Model No. L 8124A manufactured by the controls group of the Minneapolis-Honeywell Company.

Also shown in this view are stirrer motor 24, wire mesh screen 32, U-clips 52 and baffle members 62 and 64. Bolts 78 and nuts 79 are mounted and tightened to removably retain the flanges, gasket, plexiglass member and the wire mesh screen U-clips together.

PLEXIGLASS SHEET AS IN FIG. 5

Referring to the drawings and FIG. 5 there is shown the plexiglass sheet 34 which is substantially flat and square. For representation of the spacing and size of holes 36 there are crosses which are identified as 36. These are the centerline spacing for the size and placement of the holes 36 shown in FIG. 1.

CIRCUIT DIAGRAM OF FIG. 6

Figure 6:
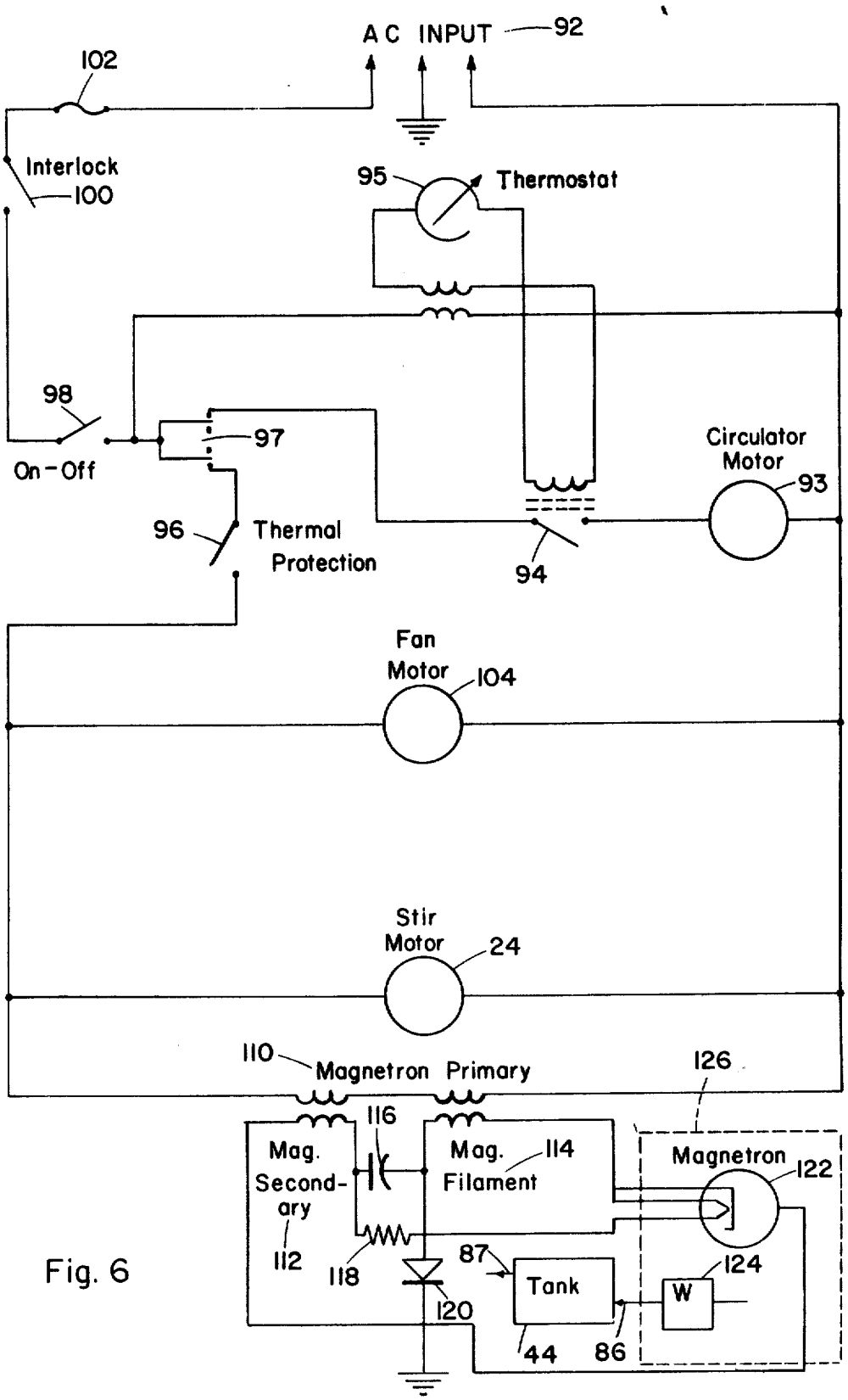
FIG. 6 represents a circuit diagram for the fluid heater apparatus depicted.

Referring next and finally to the operating circuit of this fluid heating apparatus, a reduced-to-practice circuit is depicted in FIG. 6. Electrical input is made by a plug or connector 92 which feeds electric current through the indicated conductors to the several components shown.

A circulator motor 93 is provided. It is external to the container and moves the water through the system (such as a hot water heating system) when there is a call for heat.

Solenoid 94 closes when the setting of thermostat 95 calls for heat.

Aquastat 97 includes two sets of contacts. The bottom pair (as viewed in FIG. 6) connects the power source to the electromagnetic energy generating circuitry and dispersing motor 24. When the aquastat associated with this pair detects the water temperature dropping below a certain temperature, for example 160° F., these contacts close and the wave generating and dispersing circuitry are energized. The water temperature rises as it is heated. When the temperature reaches a second threshhold, for example 170° F., the top pair of contacts associated with the aquastat closes and electrical energy is now supplied to motor 93. The water is now circulated in the system. When the temperature reaches yet a higher value, for example 190° F., the lower pair of contacts open. When this contact pair open power is cut off to the magnetron circuitry.

A thermal overload protection is provided by a switch 96. A switch 98 provides an operator actuated off-on capability. An interlock switch 100 may also be utilized with a fuse 102 which also insures the integrity of the circuit.

To provide adequate cooling of the magnetron tube there is provided a fan motor 104 mounted typically at the base of the tube. It is actuated when the magnetron is energized as explained above.

The circuit also shows the connections for firing the magnetron. A magnetron primary 110 of a transformer actuates a secondary 112 and a magnetron filament 114. A trimming capacitor 116 is connected between outputs of the two secondaries. A resistor 118 limits current through the magnetron filament. The magnetron 122 when actuated provides a controlled source of electromagnetic energy. The magnetron 122 is shielded by a screen device 126 in a known fashion.

The size and capacity of the container, the magnetron, fan and strirrer motors are a matter of choice. The thermostat 95 is adjusted to provide the selected degree of heat.

The heating apparatus, as shown and above described, provides for both a cold water inlet and a heated water outlet 86 and 87. Water is supplied from an input source 124. The pipe fittings are welded in place and provide for easy plumbing installation. A pressure relief valve connection is provided at the pipe fitting 89. The aquastat sensing means may be mounted in pipe fitting 90. The container is drained via outlet 88. Preferably a stainless steel wire mesh screen 60 is used to prevent the escape of microwaves. Plexiglass baffles are used in the fluid compartment. If and when excessive temperature is reached a thermal protection device of standard construction is provided.

The stirrer motor 24 is in the base which is separated from the fluid compartment by a plexiglass sheet and a gasket. The U-shaped clips or connectors 52 are made of metal mesh and provide a microwave barrier at the juncture of the base and water compartment above.

It is to be noted that the baffles 56, 57 and 58 are carried by the side wall members 82 and 83. The base 10 and cover member 42 are of metal which provide the desired shielding for the electromagnetic (microwave) energy.

Wire mesh screen 60 acts as a waveguide within the fluid container. The plexiglass sheet 34 is supported by the wall members 14 in the base. These intermediate members in base 10 accept and support the weight of fluid of a filled container and prevent bowing, distortion and/or fracture of sheet 34.

Terms such as "left", "right", "up", "down", "bottom", "top", "front", "back", "in", "out" and the like are applicable to the embodiment shown and described in conjunction with the drawings. These terms are merely for the purposes of description and do not necessarily apply to the position in which the fluid heating apparatus may be constructed or used.

While a particular embodiment of the electromagnetic heating apparatus has been shown and described, it is to be understood the invention is not limited thereto since modifications may be made within the scope of the accompanying claims and protection is sought to the broadest extent the prior art allows.

What is claimed is:

1. A fluid heating apparatus that utilizes electromagnetic energy for the heating of the fluid, comprising:

(a) means for producing, high frequency electromagnetic energy;

(b) container means wherein the fluid is heated, said container means including an inlet for receiving fluid in an unheated condition, and including an outlet for the discharge of heated fluid for outside use, said inlet and outlet including connections adopted for fluid-tight operation;

(c) means for dispersing said electromagnetic energy in the direction of said container means, whereby the fluid therein is heated;

(d) a base positioned in juxtaposition to said container means, said means for producing and dispersing said high frequency electromagnetic energy disposed in and on said base;

(e) means for separating said container from said base and interconnected there between, said separating means assisting in retention of the fluid in said container and preventing incursion of the fluid into said base, said separating means further characterized in that said dispersed energy can pass there through to heat said fluid; and (f) means for shielding said apparatus, whereby the escape of electromagnetic energy outside of the apparatus is substantially prevented, said shielding means including a metal mesh screen of predetermined design disposed within said container means in close proximity to the wall thereof including said inlet and said outlet, said mesh screen allowing the passage of the fluid there through, said heating apparatus further including a plurality of baffles arranged in predetermined order within said container means, said waveguide cooperating with said baffles to effect a serpentine flow of the fluid from said inlet to said outlet.

2. The fluid heating apparatus claimed in claim 1 wherein the baffles are at least three in number, said baffles disposed in said container such that alternate ends thereof are disposed inwardly from the sides thereof.

3. The fluid heating apparatus claimed in claim 1, wherein said baffles are of a sheet-like configuration, said baffles disposed substantially parallel to each other, alternate ends of said baffles terminating at said metal mesh screen which is disposed in said container means substantially normal to the plane of each of said baffles, said container means further including second baffles extending from the wall of said container means including said inlet and said outlet, said second baffles cooperating with said sheet-like baffles to provide the desired serpentine flow of the fluid.

4. The fluid heating apparatus claimed in claim 3 wherein said second baffles and said adjoining wall, including said inlet and said outlet, are fabricated from metal.

5. The fluid heating apparatus claimed in claim 1 further comprising means for cooling said electromagnetic energy source.

6. The fluid heating apparatus claimed in claim 1 wherein said base volume is partitioned by plexiglass walls, said walls having apertures therein, said base further including at least one wall thereof including a mesh screen opening, whereby air can circulate within said base volume, said mesh screen having a predetermined design whereby said electromagnetic energy is prevented from exiting from the volume of said base to outside said heating apparatus.

7. The fluid heating apparatus of claim 1 further comprising pressure relief means operatively connected within said container means.

8. The fluid heating apparatus of claim 1 wherein said container means includes means for regulating the temperature of the fluid therein, said latter means operatively connected to said electromagnetic energy producing means whereby said electromagnetic energy producing means is activated when the temperature of the fluid is to be raised and deactivated when a predetermined temperature is reached.

9. The fluid heating apparatus of claim 1 wherein said means for dispersing said electromagnetic energy is a stirrer positioned in predetermined relationship between said electromagnetic energy producing means and said container means, whereby said electromagnetic energy is directed towards said container means.

* * * * *